US010383459B2

(12) United States Patent
Sahu et al.

(10) Patent No.: US 10,383,459 B2
(45) Date of Patent: Aug. 20, 2019

(54) DEFLECTOR FOR DISPLAY CASES

(71) Applicant: Heatcraft Refrigeration Products LLC, Richardson, TX (US)

(72) Inventors: Kapil Das Sahu, Chennai (IN); Michael J. Schuetter, Columbus, GA (US); Darshan U. Shinde, Columbus, GA (US)

(73) Assignee: Kysor Warren EPTA US Corporation, Columbus, GA (US)

( * ) Notice: Subject to any disclaimer, the term of this patent is extended or adjusted under 35 U.S.C. 154(b) by 70 days.

(21) Appl. No.: 15/607,497

(22) Filed: May 28, 2017

(65) Prior Publication Data

US 2017/0258247 A1 Sep. 14, 2017

Related U.S. Application Data

(62) Division of application No. 13/858,583, filed on Apr. 8, 2013, now Pat. No. 9,687,088.

(51) Int. Cl.
*A47F 3/04* (2006.01)

(52) U.S. Cl.
CPC ..... *A47F 3/0447* (2013.01); *A47F 3/0469* (2013.01)

(58) Field of Classification Search
CPC ..... A47F 3/0469; A47F 3/0447
USPC ..... 454/173, 284
See application file for complete search history.

(56) References Cited

U.S. PATENT DOCUMENTS 1,894,205 A * 1/1933 Stollsteimer ..... A47L 1/16 312/116
2,332,174 A * 10/1943 Shreve ..... A47F 3/0447 454/189
2,442,515 A * 6/1948 Shreve ..... A47F 3/0469 312/116
2,725,726 A * 12/1955 Swanson ..... A47F 3/0447 454/233
3,134,243 A * 5/1964 Hagen ..... A47F 3/0447 454/193
3,233,423 A * 2/1966 Beckwith ..... A47F 3/0447 454/193
3,249,038 A * 5/1966 Johnson ..... F24F 13/15 454/278
3,304,736 A * 2/1967 Brennan ..... A47F 3/0447 454/193
3,314,250 A * 4/1967 Weber ..... A47F 3/0465 221/150 HC
3,319,557 A * 5/1967 Perez ..... A47F 3/0465 454/193
3,324,676 A * 6/1967 Gerweck ..... A47F 3/0447 454/193
3,347,145 A * 10/1967 Steelman ..... A47F 3/0443 454/193
3,403,525 A * 10/1968 Beckwith ..... A47F 3/0447 454/193

(Continued)

*Primary Examiner* — Steven B McAllister
*Assistant Examiner* — Samantha A Probst
(74) *Attorney, Agent, or Firm* — Hubbard Johnston, PLLC

(57) ABSTRACT

Display cases may include deflectors and fans. The deflectors may alter air currents generated by fans to provide an air current to display portions of the display case. In some implementations, the altered air current may have a first portion with a velocity that is greater than a velocity of a second portion, where the first portion is closer to a display portion of the display case.

7 Claims, 5 Drawing Sheets

(56) References Cited

U.S. PATENT DOCUMENTS 3,444,698 A * 5/1969 Lorenz ..... A47F 3/0447 62/128
3,517,526 A * 6/1970 MacMaster ..... A47F 3/0447 454/193
3,528,258 A * 9/1970 Brennan ..... A47F 3/0447 454/193
3,532,404 A * 10/1970 Toth ..... A47F 3/0469 220/592.25
3,543,532 A * 12/1970 Toth ..... A47F 3/0447 454/193
3,548,610 A * 12/1970 Kendall ..... A47F 3/0469 62/256
3,675,440 A * 7/1972 Ibrahim ..... A47F 3/0447 62/256
3,756,038 A * 9/1973 MacMaster ..... A47F 3/0447 62/256
3,771,323 A * 11/1973 Simons ..... A47F 3/0447 454/193
3,812,684 A * 5/1974 Brown ..... A47F 3/0447 454/193
3,850,003 A * 11/1974 Beckwith ..... A47F 3/0447 62/256
4,314,457 A * 2/1982 Ibrahim ..... A47F 3/0447 62/256
4,326,385 A * 4/1982 Ibrahim ..... F25D 21/125 62/256
4,338,792 A * 7/1982 Ibrahim ..... A47F 3/0447 454/193
4,352,275 A * 10/1982 Ibrahim ..... A47F 3/0469 62/256
4,370,866 A * 2/1983 Abraham ..... A47F 3/0469 62/256
4,370,867 A * 2/1983 Ibrahim ..... A47F 3/0447 62/256
4,382,461 A * 5/1983 Schenker ..... E06B 3/80 160/329
4,399,662 A * 8/1983 Ibrahim ..... F25D 21/125 62/256
4,414,822 A * 11/1983 Ibrahim ..... A47F 3/0447 62/151
4,424,685 A * 1/1984 Ibrahim ..... A47F 3/0469 160/23.1
4,449,374 A * 5/1984 Ibrahim ..... A47F 3/0447 62/256
4,457,139 A * 7/1984 Ibrahim ..... A47F 3/0443 454/193
4,537,040 A * 8/1985 Ibrahim ..... A47F 3/0469 160/1
4,628,697 A * 12/1986 Bruck ..... A47F 3/0447 220/252
4,644,854 A 2/1987 Stouffer et al.
4,777,806 A * 10/1988 Perez ..... A47F 3/0447 62/256
4,807,446 A * 2/1989 Sunaga ..... A47F 3/0447 62/256
4,945,732 A * 8/1990 Haruyama ..... A47F 3/0447 62/234
5,345,778 A * 9/1994 Roberts ..... A47F 3/0447 62/256
5,357,767 A * 10/1994 Roberts ..... A47F 3/0447 454/193
5,475,987 A * 12/1995 McGovern ..... A47F 3/0447 62/256
5,475,988 A * 12/1995 McGovern ..... A47F 3/0447 62/256
5,501,516 A * 3/1996 Federico ..... A47F 3/0447 312/116
5,707,283 A 1/1998 Oberreuter et al.
5,709,096 A * 1/1998 Tamai ..... A47F 3/0447 62/155
5,761,922 A * 6/1998 Tamai ..... A47F 3/0447 62/256
5,778,557 A * 7/1998 Leavens ..... A23L 3/00 34/222
5,996,795 A * 12/1999 Kellar ..... B65D 71/0085 206/457
6,089,970 A 7/2000 Feustel
6,240,739 B1 * 6/2001 Hayes ..... A47F 3/0482 454/193
6,381,976 B1 * 5/2002 Kempiak ..... A47F 3/0443 454/193
6,428,408 B1 8/2002 Bell et al.
6,519,962 B1 * 2/2003 Schuetter ..... A47F 3/0408 454/193
6,539,741 B2 * 4/2003 Navarro ..... A47F 3/001 454/193
6,701,735 B1 * 3/2004 Daddis, Jr. ..... A47F 3/0447 454/193
6,701,736 B1 * 3/2004 Johnson ..... A47F 3/0447 454/193
6,722,149 B1 * 4/2004 Saroka ..... A47F 3/0447 454/193
6,755,042 B2 * 6/2004 Chuang ..... A47F 3/0447 454/193
6,775,994 B1 * 8/2004 Math ..... A47F 3/0447 62/186
6,795,308 B2 * 9/2004 Blersch ..... G06F 1/1613 361/679.31
6,972,788 B1 * 12/2005 Robertson ..... G02B 27/0006 348/187
6,990,824 B1 1/2006 Jaffer et al.
7,062,932 B2 * 6/2006 Downs ..... A47F 3/0447 454/193
7,162,882 B2 * 1/2007 Alahyari ..... A47F 3/0447 62/256
7,870,830 B2 * 1/2011 Bogard ..... B63B 1/20 114/292
8,455,963 B1 6/2013 Adler et al.
2001/0003702 A1 * 6/2001 Livchak ..... A47F 3/0447 454/193
2002/0162346 A1 * 11/2002 Chiang ..... A47F 3/0447 62/246
2005/0076662 A1 * 4/2005 Roche ..... A47F 3/0447 62/246
2005/0138943 A1 * 6/2005 Alahyari ..... A47F 3/0447 62/256
2006/0059934 A1 * 3/2006 Howington ..... A47B 57/045 62/256
2006/0199495 A1 * 9/2006 Yamaguchi ..... A47F 3/001 454/173
2006/0240761 A1 * 10/2006 Yamaguchi ..... A47F 3/001 454/184
2007/0015449 A1 1/2007 Livchak
2007/0251253 A1 * 11/2007 Alahyari ..... A47F 3/0447 62/256
2009/0061754 A1 3/2009 Hlavka et al.
2009/0098818 A1 4/2009 Gruenberg
2009/0205351 A1 * 8/2009 Fung ..... A47F 3/0447 62/256
2009/0215381 A1 * 8/2009 Swofford ..... A47F 3/0447 454/193
2010/0064712 A1 * 3/2010 Esformes ..... A47F 3/0447 62/255
2010/0195392 A1 8/2010 Freeman
2011/0259031 A1 * 10/2011 Anderson ..... A47F 3/0447 62/251
2012/0020044 A1 1/2012 Iihola et al.
2012/0042675 A1 * 2/2012 Stephens ..... A47F 3/0447 62/256
2012/0174605 A1 7/2012 Huff et al.
2012/0206805 A1 8/2012 Meng et al.
2013/0019621 A1 * 1/2013 Wood ..... A47F 3/0447 62/126
2013/0143480 A1 6/2013 Trevelyan
2013/0213074 A1 * 8/2013 Nguyen ..... A47F 3/0443 62/255
2013/0316635 A1 * 11/2013 Sipila ..... F24F 9/00 454/192

(56) References Cited

U.S. PATENT DOCUMENTS

| | | | | |
|---|---|---|---|---|
| 2013/0319030 | A1* | 12/2013 | Nguyen | A47F 3/0447 62/256 |
| 2014/0290156 | A1 | 10/2014 | Bruce et al. | |
| 2014/0299672 | A1 | 10/2014 | Gopalan et al. | |
| 2016/0016024 | A1 | 1/2016 | Runyan | |
| 2016/0054071 | A1 | 2/2016 | Cordova et al. | |
| 2016/0090174 | A1 | 3/2016 | White | |
| 2016/0129621 | A1 | 5/2016 | Lisch et al. | |

* cited by examiner

DEFLECTOR FOR DISPLAY CASES

RELATED APPLICATION

This application is a Divisional of U.S. application Ser. No. 13/858,583, filed on Apr. 8, 2013, which is incorporated herein by reference for all purposes in its entirety.

TECHNICAL FIELD

The present disclosure relates to deflectors, and more particularly to deflectors for display cases.

BACKGROUND

Display cases are often used to present items, such as food or other goods. Display cases may include open design cases (e.g., where at least one area is open to the ambient air) and closed cases. The display cases may be refrigerated, chilled, and/or heated depending on the item to be presented in the display case.

SUMMARY

In various implementations, a display case may include a deflector and a fan. The deflector may include two opposing surfaces. The deflector may include a first member and a second member that are approximately 149 degrees to approximately 153 degrees apart on the first surface of the deflector. The fan may generate a gas current directed at the second surface of the deflector.

Implementations may include one or more of the following features. The display case may include a flow straightener coupled to the deflector. The second surface proximate the second member may be disposed approximately 9 degrees to approximately 13 degrees from a surface of the flow straightener. The display case may include a display portion. The deflector may alter a gas current such that a velocity of a first portion of the gas current is greater than a velocity of a second portion of the gas current. The first portion of the gas current may be closer to the display portion than the second portion of the gas current. A third portion of the gas current, disposed between the first portion and the second portion, may be less than or approximately equal to the velocity of the second portion of the gas current. The first member may be approximately 1.9 inches to approximately 2 inches high. The second member may be approximately 2.5 inches to approximately 2.9 inches high. The second member may include a coupling portion with an approximately 90 degree recess to receive the flow straightener.

In some implementations, a display case may include a flow straightener, a deflector, and a fan. The flow straightener may include a first end, a second end, and a reference position approximately 0.8 times the distance between the first end and the second end of the flow straightener. The deflector may include a first member with a first position proximate an end and a second member with a second position proximate an end. The first and second members may be coupled proximate a third position. The distance from the third position of the deflector to the reference position of the flow straightener may be defined as a first distance and the distance between a first position of the deflector and a first end of the flow straightener may be approximately 3.5 times the first distance. A fan may generate a gas current directed to a surface of the deflector.

Implementations may include one or more of the following features. The flow straightener and the deflector may be coupled proximate the second position of the deflector and proximate the second end of the flow straightener. A display case may include a display portion. A predetermined temperature range may be maintained in a display portion of the display case using at least a portion of the gas current. The deflector may alter the gas current such that a velocity of a first portion of the gas current is greater than the velocity of a second portion of the gas current. The first portion of the gas current may be disposed closer to a display portion of the display case than the second portion. A third portion of the gas current may be disposed between the first portion and the second portion of the gas current. A velocity of the third portion may be less than or approximately equal to a velocity of the second portion of the gas current. The first member of the deflector may be approximately 1.9 inches to approximately 2 inches high and/or the second member of the deflector may be approximately 2.5 inches to approximately 2.9 inches high. The flow straightener may have an aspect ratio of approximately 8 to approximately 1.

In some implementations, a temperature range may be maintained in the display case. A gas current may be generated in a first direction using a fan of the display case. The first direction of the gas current may be altered using at least a portion of a deflector of the display case. A velocity of a first portion of the altered gas current may be greater than a velocity of a second portion of the altered gas current, where the first portion of the altered gas current is closer to a display portion of a display case than the second portion.

Implementations may include one or more of the following features. A predetermined temperature range may be maintained in a display portion of the display case using the altered gas current. The energy consumption by a display case to maintain the predetermined temperature range may be reduced when compared to the energy consumption to maintain the predetermined temperature range using a gas current that has not been altered by the deflector. A velocity of a third portion of the altered gas current disposed between the first and the second gas current may be less than or approximately equal to the velocity of the second portion of the altered gas current. The gas current may be straightened. The altered gas current may be provided to the display portion of the display case.

The details of one or more implementations are set forth in the accompanying drawings and the description below. Other features, objects, and advantages of the implementations will be apparent from the description and drawings.

BRIEF DESCRIPTION OF THE DRAWINGS

For a more complete understanding of this disclosure and its features, reference is now made to the following description, taken in conjunction with the accompanying drawings, in which.

Like reference symbols in the various drawings indicate like elements.

DETAILED DESCRIPTION

Display cases may hold various products including food products, such as meat, cheese, fruit, hot food items, and other products. The products in the display case may be temperature sensitive. For example, food products may spoil and/or bacteria growth may be promoted when the food products are kept at ambient temperatures. The performance of some products may be temperature sensitive. When ambient temperatures exceed or are below an operational temperature range, products may be stored in a display case with a controlled temperature environment. When the display case includes opening areas, for example, so that the displayed products may be removed without removing a portion of the display case, such as a cover, a gas current may be generated to flow above or proximate displayed items and maintain a temperature of the products in a desired temperature range (e.g., for food safety, for temperature sensitive product performance, etc.).

Figure 1:
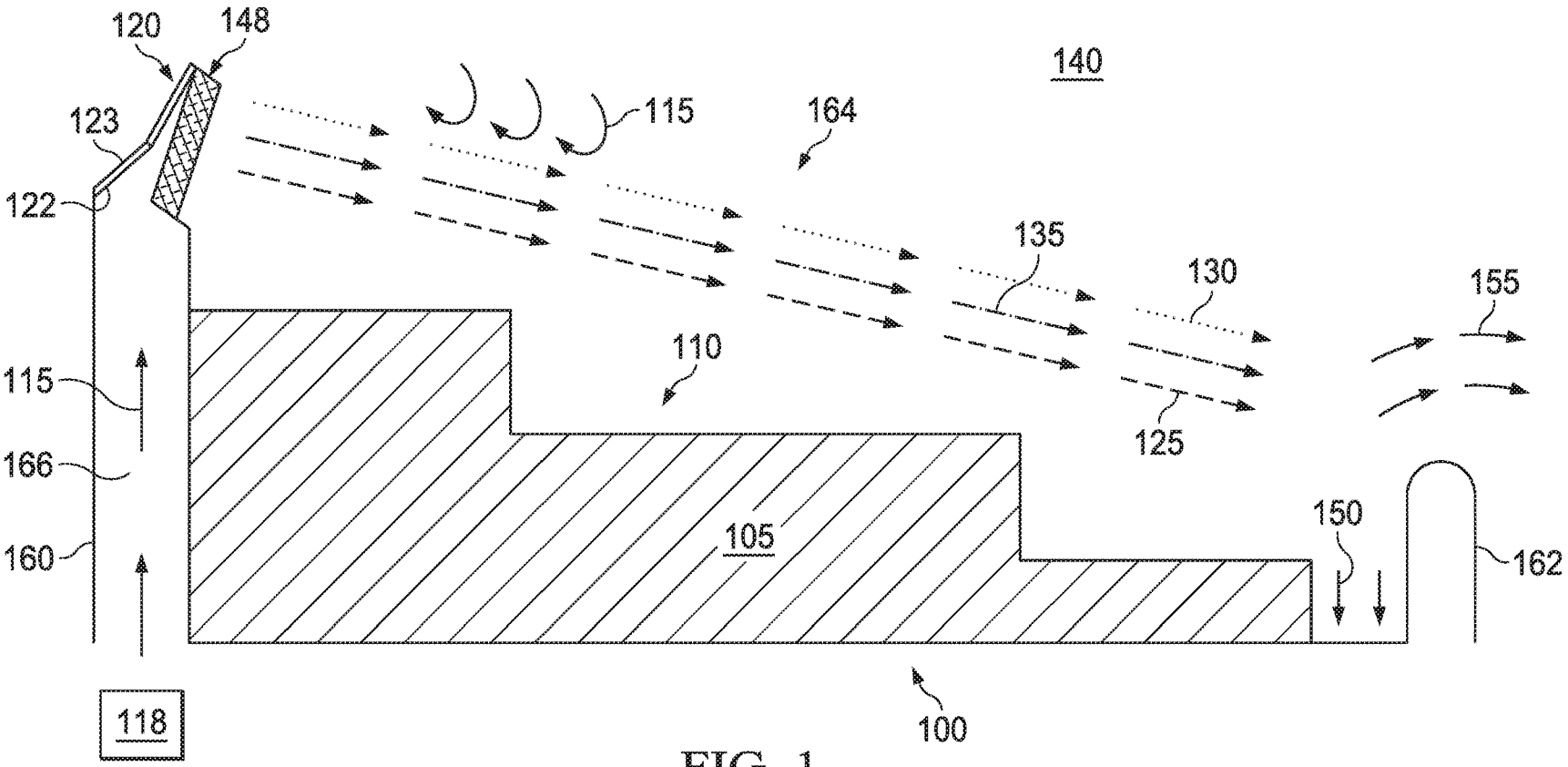
FIG. 1 illustrates a cross-sectional view of an embodiment of a part of an example display case.

FIG. 1 illustrates an implementation of part of an example open display case 100. The display case 100 may include a display portion 105. As illustrated in FIG. 1, the display case 100 includes an open area above at least a portion of the display portion 105. Open display cases may facilitate access to products disposed in the display portion 105 and/or facilitate marketing of the products in the open display cases to consumers. Various products may be presented and/or disposed in the display portion 105. For example, meat and/or cheese may be positioned at least partially in recesses 110 in the display portion 105. The display portion may include recesses, protrusions, gripping surfaces and/or other retention members to retain items at least partially in the display portion.

In some implementations, a temperature of a product and/or regions proximate a product may be maintained by the display case 100 within a predetermined temperature range. The predetermined temperature range may be based on a temperature sensitivity of the product. For example, the predetermined temperature range may be at least partially based on government (e.g., federal, state, and/or local) regulations regarding food safety. As another example, the predetermined temperature range may be at least partially based on consumption and/or consumer preferences for temperature ranges (e.g., ice cream may be maintained at a predetermined temperature range to inhibit melting while maintaining desirable temperature properties for consumers, chocolate may be maintained at a predetermined temperature range to inhibit melting while maintaining chocolate properties desirable by the seller, meat may be kept at a temperature that inhibits bacteria growth and promotes food safety while inhibiting freezing of the meat, etc.). The predetermined temperature range may be at least partially based on ambient temperatures (e.g., when ambient temperatures are outside a selected temperature range) and/or product performance.

A gas current or stream, such as an air current 115, may be generated by a fan 118 of the display case. The fan 118 may be disposed at least partially in and/or may be coupled to the display case. The fan 118 may be an axial flow fan, a centrifugal fan, a blower, and/or any other appropriate type of fan. The fan 118 may produce a flow of a gas, such as air. The gas current generated may have controllable properties, such as velocity, volumetric flow rate, pressure, and/or temperature.

The air current 115 generated by the fan 118 may be directed at a deflector 120. For example, the display case 100 may be designed to allow the air current 115 to flow from the fan to the deflector. The deflector 120 may have two opposing surfaces 122, 123. The air current 115 may be directed at a first surface 122 of the deflector 120. The air current 115, in some implementations, may be inhibited from contacting the second surface 123 of the deflector 120.

Figure 2:
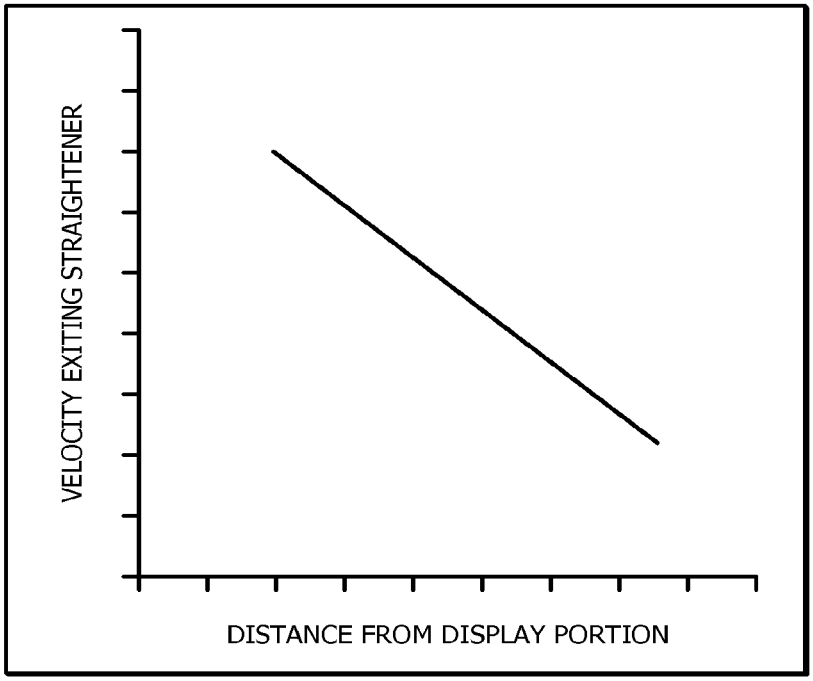
FIG. 2 illustrates an embodiment of an example velocity profile of a gas stream in an example display case, as illustrated in FIG. 1.
Figure 3:
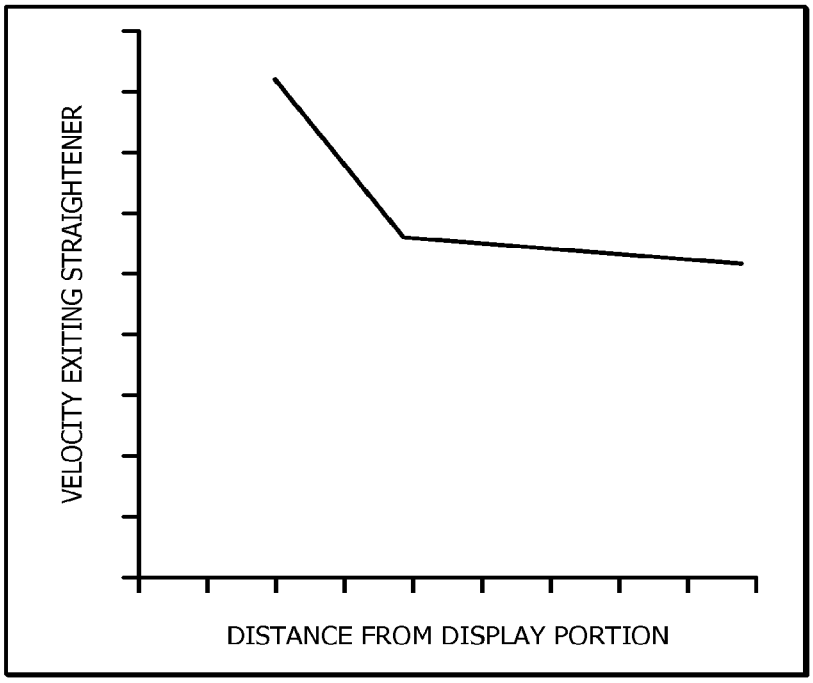
FIG. 3 illustrates an embodiment of an example velocity profile of a gas stream for an example display case, as illustrated in FIG. 1.

The deflector 120 may alter properties of the air current 115. For example, the deflector 120 may alter the direction of flow of the air current 115. The deflector 120 may alter the air current 115 to achieve a predetermined air velocity profile. FIGS. 2 and 3 illustrate an example air velocity profile generated by a display case, such as the display case illustrated in FIG. 1. As illustrated in FIGS. 2 and 3, the deflector 120 may alter the air current 115 such that a velocity of a first portion 125 of the altered air current is greater than the velocity of a second portion 130 of the altered air current. The first portion 125 of the altered air current may be closer to the display portion 105 of the display case 100 than the second portion 130 of the altered air current. A third portion 135 of the altered air current may be disposed between the first portion 125 and the second portion 130 of the altered air current. The third portion 135 may have a velocity less than the velocity of the first portion 125 of the altered air current, as illustrated in FIGS. 2 and 3. In some implementations, the velocity profile may gradually decrease from the area proximate the display portion towards the area proximate the ambient air environment. For example, the velocity of first portion 125 may be greater than the velocity of the third portion 135 and the velocity of the second portion 130 may be less than the velocity of the third portion.

In some implementations, a velocity of a first portion 125 of the altered air current may be maintained below a selected maximum velocity to reduce turbulence proximate the display portion. An increased turbulence may reduce the energy efficiency of the display case 100 and/or increase air infiltration from ambient air 140. The ambient air 140 may be a temperature outside the predetermined temperature range selected for the display case and so infiltration of ambient air may require more energy to maintain a predetermined temperature range. A velocity of a second portion 130 of the altered air current may be selected such that infiltration from ambient air 140 is minimized and/or to minimize turbulence 145 in the region proximate ambient air 140.

The deflector 120 directs the altered air current towards a flow straightener 148. The flow straightener 148 may straighten the altered air current. For example, the flow straightener 148 may increase laminar properties of the altered air current. The flow straightener may reduce eddies and/or currents in directions other than the general direction of flow of the altered air current. As illustrated in FIG. 1, the deflected and straightened air current may then flow above the display portion 105 of the display case 100. The air current may maintain the products in the display portion 105 in a predetermined temperature range. After passing proximate the display portion 105, portions of the air current may be recycled 150 and/or spillover 155 the display case. The alteration of the air current by the deflector may inhibit and/or reduce spillover 155 of the air current from the display case when compared with display cases without similar deflectors. The recycled portion 150 of the air current may be regenerated as a portion of air current 115.

Although the gas stream has been described as having one or more portions, the portions may or may not have uniform properties. For example, a portion may have different velocities across a length, height, and/or width. A portion may have an average velocity as the portion velocity. As another example, a portion may be a section of the gas stream with an approximately uniform velocity.

Although the display case 100 in FIG. 1 is illustrated as a horizontal display case with a horizontal display portion 105, the display case may be oriented in other directions. For example, a display case may be vertically oriented and include a vertical display potion with recesses, such as shelves, to present items. As another example, a display case may be vertically oriented and include an angled display portion. The angled display portion may include recesses, protrusions, gripping surfaces and/or other retention members such that items may be disposed at least partially in and/or presented in the display portion.

Figure 4:
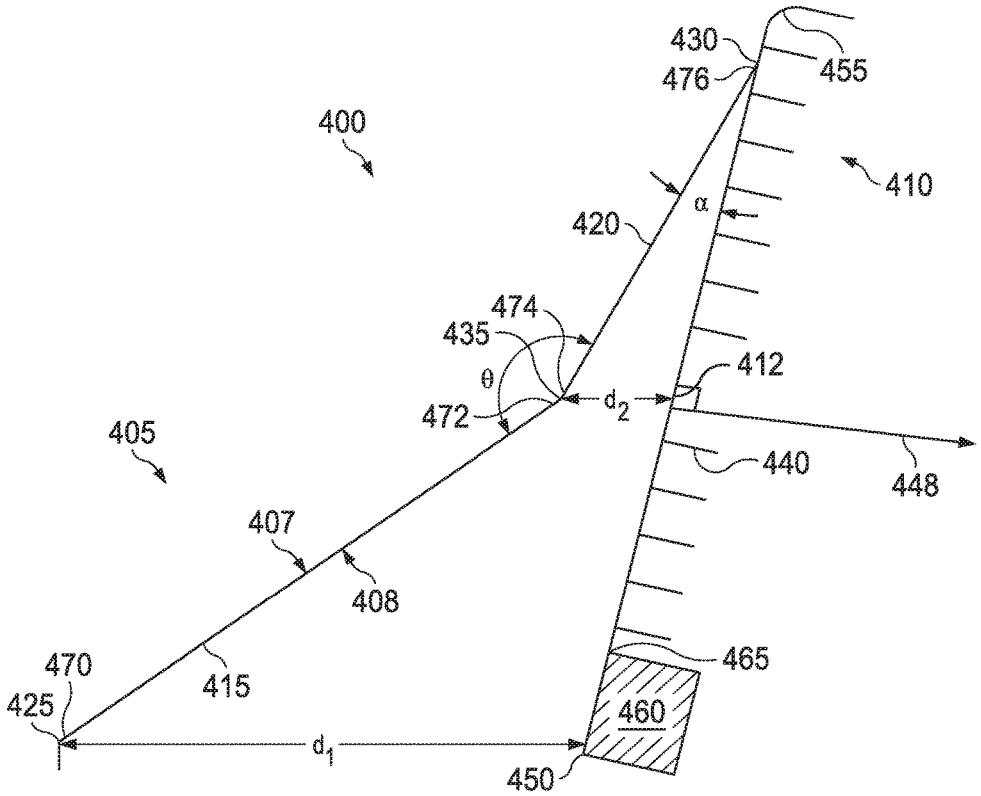
FIG. 4 illustrates a cross-sectional view of an embodiment of a part of an example display case.

FIG. 4 illustrates an implementation of a portion 400 of an example display case. The portion 400 includes a deflector 405 and a flow straightener 410. The deflector 405 may include two opposing surfaces, a first surface 407 and a second surface 408. Portions of a generated air current may contact the second surface 408 of the deflector. Portions of the generated air current may be inhibited from contacting the first surface 407 of the deflector 405. For example, air flow generated by a fan in the display case may be at least partially restricted by a cavity in the display case, formed at least partially by the deflector and/or fan. The air flow may be directed to flow towards the deflector 405 and/or towards the flow straightener 410.

The deflector may include a first member 415 and a second member 420. The first and second members may be coupled proximate a coupling position 435. The first end 425 of the deflector may be coupled to the display case. For example, the first end 425 may be coupled to a portion of the display case (e.g., a surface of the display case and/or coupled to a channel through which air from the fan flows) at approximately 123 degrees to approximately 127 degrees. A second end 430 of a deflector 405 may be coupled to the flow straightener 410.

The first member 415 and the second member 420 may be portions of a single body deflector. For example, the first member 415 and the second member 420 may be formed from a piece of deformed metal and/or plastic. The first member 415 and the second member 420 may be welded and/or otherwise coupled at a desired relative position.

The first member 415 and the second member 420 may be disposed at a first angle 8, relative to each other. The first angle 8 may be measured from the first surface 407 of both the first member 415 and the second member 420. For example, the first angle, 8, may be from approximately 146 to approximately 156 degrees. The first angle, 8, may be from approximately 149 degrees to approximately 153 degrees. The first surface 407 may be opposed to the second surface 408, which contacts and/or deflects portions of the air current generated in the display case.

The second member 420 of the deflector 405 may be disposed at a second angle, $\alpha$, from the flow straightener 410. The second angle, $\alpha$, of the deflector may be approximately 6 degrees to approximately 16 degrees. The second angle, $\alpha$, of the deflector may be approximately 9 degrees to approximately 13 degrees. The second angle, $\alpha$, of the deflector 405 may be measured from the second surface 408 of the second member 420 to a surface of the flow straightener 410 proximate the deflector and/or proximate where the deflector and the flow straightener are coupled.

In some implementations, the first member 415 of the deflector 405 may be approximately 1.5 to approximately 2.5 inches high. The first member 415 may be approximately 1.9 to approximately 2 inches high. The second member 420 of the deflector 405 may be approximately 1.5 to approximately 3 inches high. The second member 420 may be approximately 2 to approximately 2.5 inches high. The first member 415 may be smaller in height than the second member 420. For example, the distance between a first end 425 of the deflector 405 and the coupling position 435, between the first member 415 and the second member 420, may be less than the distance between the coupling position and the second end 430 of the deflector.

In some implementations, the deflector 405 may include a recessed portion to receive the flow straightener 410. The recessed portion may be proximate the second end 430 of the deflector 405. The deflector 405 may include a protrusion to facilitate coupling to the flow straightener 410. For example, the deflector 405 may include an approximately 90 degree recess to receive a flow straightener. As another example, the deflector 405 may include a flexible coupling member that allows the flow straightener 410 to be fixably coupled to the deflector at various angles.

The flow straightener 410 may include channels 440 that allow a gas to flow through the flow straightener. The flow straightener 410 may further alter the direction of portions of the air current altered by the deflector 405. The gas may flow in a general direction of flow 448 that is parallel to the channels 440 and/or perpendicular to a surface of the flow straightener 410, as illustrated in FIG. 4. The channels 440 may straighten the flow of at least portions of the gas current. For example, the channels 440 of the flow straightener 410 may make the stream of gas more laminar.

The flow straightener 410 may include members to couple with portions of the deflector 405. The flow straightener 410 may include a portion 460 through which flow is restricted. For example, a flow straightener 410 may include a restricted portion 460 proximate the display portion of a display case such that air flow through the flow straightener is directed at a distance above items in the display portion. Directing air flow at a specified distance above the items in the display portion may reduce ambient air infiltration and/or reduce turbulence in the air current. In some implementations, the flow straightener 410 may include an 8:1 aspect ratio honeycomb air straightener.

In some implementations, as a gas current flows towards the deflector 405, the direction of the gas current is altered such that a velocity of a first portion of the gas current proximate the display portion is greater than a velocity of a second portion of the gas current. The altered gas current from the deflector 405 is directed towards the flow straightener 410. As the altered gas current passes through the flow straightener 410, the direction of various portions of the gas current may become more uniform with respect to the general direction of flow 448. The channels 440 may at least partially determine the general direction of flow 448. Eddies may be reduced in size and/or magnitude. The general direction of flow 448 may be approximately parallel to channels 440 positioned at least partially in the flow straightener 410 and/or perpendicular to a surface of the flow straightener 410. In some implementations, portions of the gas current moving in directions other than the general direction of flow 448 may be altered to more closely align with the general direction of flow. For example, the channels 440 may alter the direction of flow of portions of the altered air current to be approximately parallel with a direction of the channels and/or the general direction of flow 448.

In some implementations, the deflector 405 may include a first position proximate a first end 425 and a second position proximate a second end 430 of the deflector. The deflector 405 may be coupled to the flow straightener 410 proximate the second position. The deflector 405 may include a coupling position 435 proximate the locations where the first member 415 and the second member 420 are coupled. A distance, d1, may be the distance between a first position proximate a first end of the deflector and a first end 450 of the flow straightener 410. A distance, d2, may be the distance between the coupling position 435 of the deflector 405 and a reference position 412 that is 0.8 times a height of the flow straightener 410. In some implementations, the reference position 412 is approximately 0.78 to approximately 0.82 times a height of a flow straightener. The height of the flow straightener 410 may be the distance between the first end 450 of the flow straightener and the second end 455 of the flow straightener. The height of the flow straightener 410 may not include a restricted flow portion 460 of the flow straightener. As an example, the height of the flow straightener 410 may be a distance from a second end of the flow straightener to a position 465 proximate an end of the restricted flow portion 460. In some implementations, a first member 415 of the deflector 405 may have a slope based on a ratio of d1 and d2. As an example, the ratio of d1: d2 may be approximately 1:3.5. As another example, the ratio of d1: d2 may range from approximately 1: approximately 3 to approximately 1: approximately 4.

Figure 5:
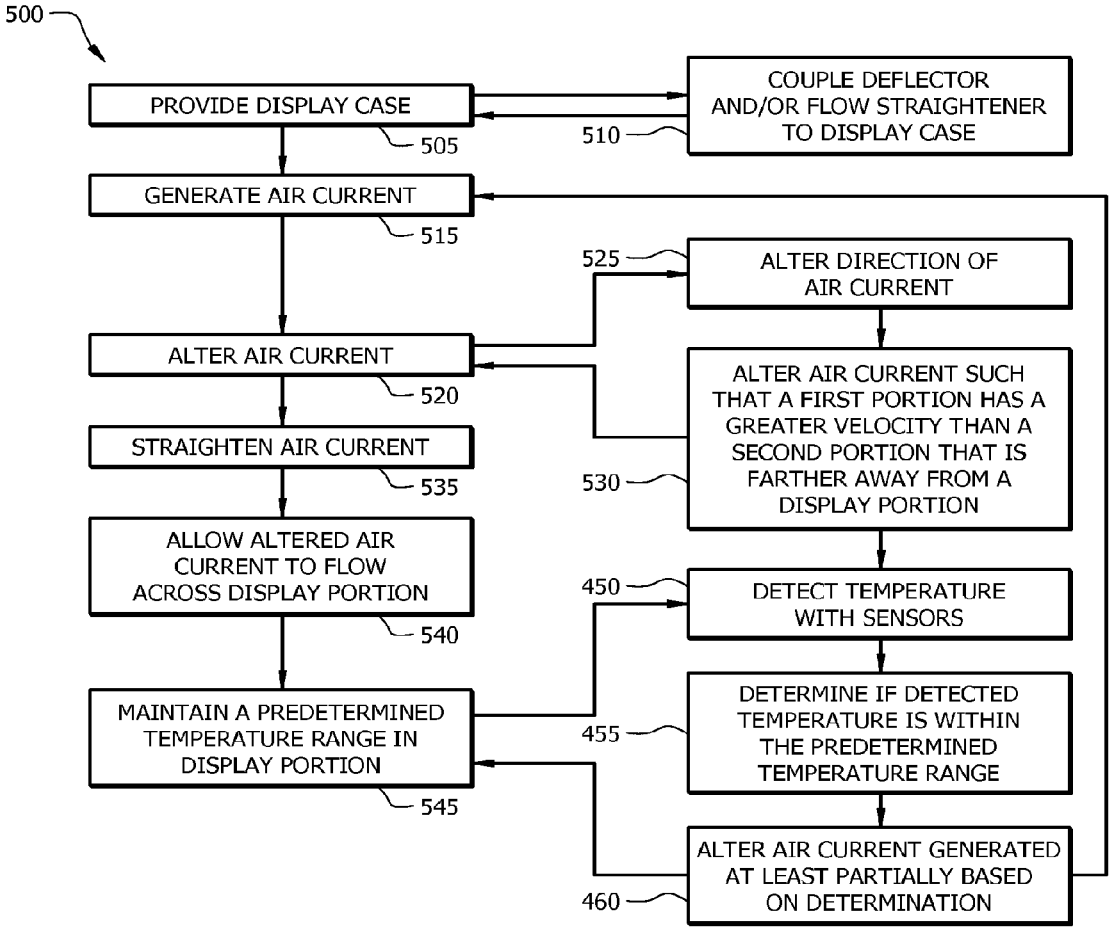
FIG. 5 illustrates a process for maintaining temperatures in the example display case illustrated in FIG. 1.

FIG. 5 illustrates a process 500 for maintaining a temperature of a display case. A display case may be provided (operation 505). For example, an air deflector and/or flow straightener may be coupled to a new and/or an existing display case (operation 510). An air current may be generated (operation 515). For example, the air current may be generated by a 1100 RPM fan at least partially disposed in the display case. The properties of the air current, such as temperature and/or velocity, may be selected such that a predetermined temperature can be obtained in the display portion of the display case. As an example, an air current may be generated to maintain a display portion and/or product, such as meat, in the display portion at a temperature range of approximately 28° F. to approximately 32° F.

The generated air current may be altered (operation 520). For example, the deflector may alter the generated air current. The direction of the air current may be altered (operation 525). For example, the direction of the air current may be directed towards the air straightener and/or the display portion of the display case.

The deflector may also alter the velocity profile of the air current. The velocity profile of the air current may be altered such that a velocity of a first portion of the air current may be greater than a velocity of a second portion of the air current (operation 530). The first portion of the air current may be closer to the display portion of the display case than the second portion. In some implementations, the velocity profile of the air current may be altered such that the first portion has a first maximum velocity and the second portion has a second minimum velocity. The velocity of the portions between the first portion and the second portion may gradually decrease from the first maximum velocity to the second minimum velocity.

In some implementations, the higher velocity second portion may promote maintenance of a predetermined temperature range in the display portion and/or the lower velocity second portion may reduce the influence of ambient air on the air current (e.g., on temperature though turbulence and/or eddies in the current). In some implementations, the display case may have increased energy efficiency since the lower velocity second portion of the air current may decrease infiltration of ambient air in the air current and/or may decrease temperature fluctuations arising from ambient air mixing with the air current and reducing an overall temperature of the air current. Utilization of a deflector that produces an air current with a high velocity portion proximate the display portion of the display case and a lower velocity portion less proximate the display portion than the high velocity portion may require less energy use to maintain predetermined temperature ranges by the display case, when compared to display cases without this type of deflector. In some implementations, achieving this velocity profile may decrease spillover from the display case.

The straightness of the altered air current may be increased (operation 535). For example, a flow straightener may increase the straightness of the altered air current (e.g., increase laminar properties, reduce eddies, and/or reduce the number of portions of the air current flowing in directions other than a general current of flow parallel to channels in the flow straightener).

The altered air current may flow across a display portion of the display case (operation 540). For example, product may be positioned in a display portion and the air current may be provided to flow at a distance above the product. The distance above the product may be determined, in some implementations, by a restricted flow portion of a flow straightener.

A predetermined temperature range may be maintained in the display portion (operation 545). For example, a temperature in a display portion and/or in meat in a display portion may be maintained between approximately 28° F. to approximately 32° F. The temperature range may be determined based on food safety guidelines, when food is to be positioned in the display portion.

The display case may include sensors. The sensors may detect temperature (operation 550). For example, thermoresistor and/or thermometer may be disposed in and/or proximate the display portion and measure temperatures and/or deviations in temperatures of the display portion. A determination may be made whether the detected temperature is within the predetermined temperature range (operation 555). For example, the detected temperature and/or temperature variance may be compared to a selected predetermined temperature range for a display case. The generated air current may be altered based at least partially on the determination (operation 560). For example, if a determination is made that the temperature is outside of the selected predetermined temperature range, the air current may be altered (e.g., temperature, velocity, flow rate, etc.). In some implementations, if a determination is made that the temperature is within the predetermined range, then the generated air current may not be altered.

Process 500 may be implemented by various systems, such as system 100. In addition, various operations may be added, deleted, or modified. For example, sensors may not be used to determine temperature. As another example, the air current may be altered and straightened concurrently. The air current may not be straightened, in some implementations.

In some implementations, the first portion and the second portion of the deflector may be a single piece or two or more pieces coupled together. The first and second portions of the deflector may be created by bending or otherwise altering a piece of deformable material. The coupling point between the first and second members in such implementations may reference a position proximate the bend in deflector. In some implementations, the deflector may include an integrated flow straightener.

Although air is used as an example of the gas used in the display case, other gasses and combinations of gas may be used. For example, a gaseous stream or current with more nitrogen than ambient air may be utilized. As another example, a gaseous stream may include more carbon dioxide than ambient air.

Although a specific implementation of the system is described above, various components may be added, deleted, and/or modified. In addition, the various temperatures and/or gases are described for exemplary purposes. Temperatures and/or gases may vary, as appropriate.

It is to be understood the implementations are not limited to particular systems or processes described which may, of course, vary. It is also to be understood that the terminology used herein is for the purpose of describing particular implementations only, and is not intended to be limiting. As used in this specification, the singular forms "a", "an" and "the" include plural referents unless the content clearly indicates otherwise. Thus, for example, reference to "a gas current" includes a combination of two or more gas currents and reference to "a gas" includes different types and/or combinations of gases. As another example, "coupling" includes direct and/or indirect coupling of members.

Although the present disclosure has been described in detail, it should be understood that various changes, substitutions and alterations may be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

EXAMPLES

Example 1

Figure 6:
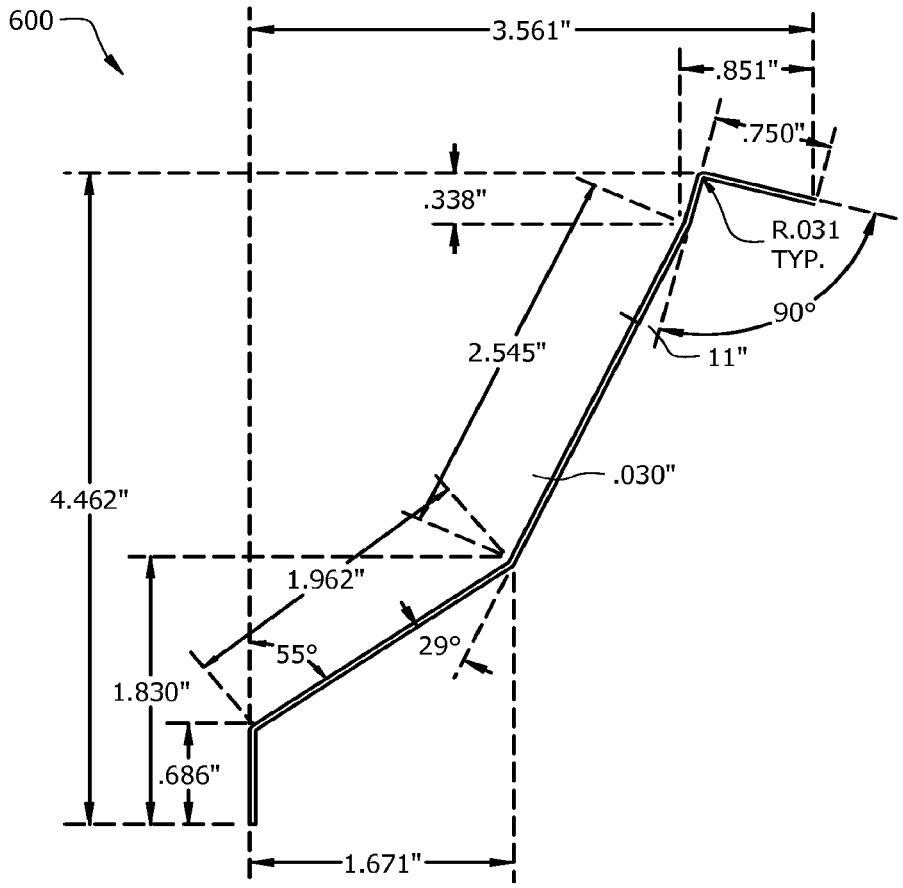
FIG. 6 illustrates a cross-sectional view of an example deflector.

The deflector 600 illustrated in FIG. 6 was utilized in an open display case, such as the display case illustrated in FIG. 1. An 1100 RPM fan was used to generate an air current. An 8:1 aspect ratio honeycomb flow straightener was utilized. A velocity profile as illustrated in Table 1 was observed.

TABLE 1

| Velocity Profile | | | |
|---|---|---|---|
| Velocity Measurement Position | Velocity at Left End of Case (FPM) | Velocity at Center of Case (FPM) | Velocity at Right End of Case (FPM) |
| Top Edge of Flow Straightener | 210 | 220 | 225 |
| Center of Flow Straightener | 180 | 200 | 190 |
| Bottom Edge of Flow Straightener | 225 | 260 | 250 |

As illustrated, a velocity profile was achieved in which a velocity of a portion of the air current proximate a display portion of the display case (Bottom Edge of Flow Straightener measurement position) was greater than the velocity of portion proximate the center of the air current (Center of Flow Straightener measurement position) and the velocity of the portion of the generated air current farthest away from the display portion (Top Edge of Flow Straightener measurement position). Energy usage was observed to be lower than when utilizing a display case without a similar velocity profile, in use.

Referring again to FIG. 1, the refrigerated display case 100 has a first display case wall 160 and a second display case wall 162 separated from the first display case wall 160 and having an open display portion 164 between the first display case wall 160 and the second display case wall 162. A duct 166 is positioned and configured to receive the gas current, e.g., air current 115, from the fan 118 and deliver the gas current to the deflector 120.

Referring now again to FIG. 4, the first member 415 has a first end 470 and a second end 472. The second member 420 has a first end 474 and a second end 476.

What is claimed is:

1. A refrigerated display case comprising:

a first display case wall;

a second display case wall separated from the first display case wall and having an open display portion between the first display case wall and the second display case wall, and wherein an open area is adjacent to the display portion;

a fan for generating a gas current, wherein the fan is associated with the first display case wall;

a deflector coupled to a portion of the first display case wall;

a duct positioned and configured to receive the gas current from the fan and deliver the gas current to the deflector; and wherein the deflector comprises:

a first surface, a second surface opposed to the first surface, a first member having a first end and a second end, and a second member having a first end and second end, wherein the first end of the second member is coupled to the second end of the first member, wherein the first surface proximate the second member is disposed approximately 149 degrees to approximately 153 degrees from the first surface proximate the first member, and whereby the deflector produces a first portion of the gas current having a first velocity and a second portion of the gas current having a second velocity that is slower than the first velocity and wherein the first portion of the gas current is closer to the display portion than the second portion of the gas current.

2. The display case of claim 1 comprising a flow straightener coupled to the deflector.

3. The display case of claim 2 wherein the second surface proximate the second member is disposed approximately 9 degrees to approximately 13 degrees from a surface of the flow straightener.

4. The display case of claim 1 wherein a velocity of a third portion of the gas current is greater than the velocity of the second portion of the gas current and less than the velocity of the first portion of the gas current, wherein the third portion of the gas current is disposed between the first portion and the second portion of the gas current.

5. The display case of claim 1 wherein the first member comprises a first dimension approximately 1.9 inches to approximately 2 inches in length, and wherein the second member comprises a second dimension approximately 2.5 inches to approximately 2.9 inches in length.

6. A refrigerated display case comprising:

a display case housing formed with an display portion and having an open area adjacent the display portion;

a fan for generating an air current;

a deflector coupled to a portion of the display case housing, the deflector having an first outward facing surface and a second inward facing surface;

a duct coupled to the fan for receiving the air current and delivering the air current to the second surface of the deflector;

wherein the deflector further comprises:

a first member, a second member coupled to the first member at an angle θ formed between the first member and the second member measured on a first side, wherein the angle θ is between about 149 degrees to about 153 degrees, whereby the air current from the fan upon impacting the deflector produces at least a first portion of the air current and a second portion of the air current, wherein a velocity of the first portion of the air current is greater than a velocity of the second portion of the air current, and wherein the first portion of the air current is closer to the display portion than the second portion of the air current.

7. The refrigerated display case of claim 6, wherein a velocity of a third portion of the air current is less than the first portion of the air current and faster than the second portion of the air current, and wherein the third portion is positioned between the first portion of the air current and the second portion of the air current.

* * * * *